US012173521B2

(12) United States Patent
Fadel et al.

(10) Patent No.: US 12,173,521 B2
(45) Date of Patent: Dec. 24, 2024

(54) APPARATUSES AND SYSTEMS FOR BRACING VERTICAL STRUCTURES

(71) Applicant: OSMOSE UTILITIES SERVICES, INC., Peachtree City, GA (US)

(72) Inventors: Keith Fadel, Amherst, NY (US); Jeffrey R. Giffen, Peachtree City, GA (US); Lawrence J. Geitner, Hamburg, NY (US); Stephanie Singer, Peachtree City, GA (US); Mark E. Messenger, Newnan, GA (US)

(73) Assignee: OSMOSE UTILITIES SERVICES, INC., Peachtree City, GA (US)

( * ) Notice: Subject to any disclaimer, the term of this patent is extended or adjusted under 35 U.S.C. 154(b) by 281 days.

(21) Appl. No.: 17/590,616

(22) Filed: Feb. 1, 2022

(65) Prior Publication Data

US 2022/0243493 A1 Aug. 4, 2022

Related U.S. Application Data

(60) Provisional application No. 63/145,146, filed on Feb. 3, 2021.

(51) Int. Cl.
*E04H 12/22* (2006.01)
*E04G 23/02* (2006.01)

(52) U.S. Cl.
CPC ..... *E04H 12/2292* (2013.01); *E04G 23/0225* (2013.01)

(58) Field of Classification Search
CPC ..... E04H 12/2292; E04H 23/0225; E04G 23/0225
See application file for complete search history.

(56) References Cited

U.S. PATENT DOCUMENTS

| | | | | |
|---|---|---|---|---|
| 4,615,156 | A | 10/1986 | Deike | |
| 4,987,718 | A | 1/1991 | Knight | |
| 6,079,165 | A * | 6/2000 | Bingel, III | E04H 12/2292 52/170 |
| 7,363,752 | B2 * | 4/2008 | Bingel, III | E04G 23/0225 52/835 |
| 7,415,808 | B2 * | 8/2008 | Bingel, III | E04G 23/0225 52/170 |
| 2012/0131864 | A1 * | 5/2012 | Blaylock | E04H 12/2292 52/170 |
| 2022/0243493 | A1 * | 8/2022 | Fadel | E04H 12/2292 |

* cited by examiner

*Primary Examiner* — Andrew J Triggs
(74) *Attorney, Agent, or Firm* — Troutman Pepper Hamilton Sanders LLP; James E. Schutz; Korbin M. Blunck

(57) ABSTRACT

A pole reinforcement truss is disclosed. The truss can be configured to attach to a pole in a longitudinal direction of the pole. The truss can include an elongate body having a pair of opposite ends connected by a pair of longitudinal edges, a first side portion including one of the longitudinal edges, a second side portion including the other of the longitudinal edges, and a center portion connecting the first side portion and the second side portion. The first side portion can include a first substantially straight section and a second substantially straight section separated by a first bend having a first angle that is greater than 45 degrees, and the second side portion can include a third substantially straight section and a fourth substantially straight section separated by a second bend having a second angle that is greater than 45 degrees.

20 Claims, 14 Drawing Sheets

PRIOR ART

100

APPARATUSES AND SYSTEMS FOR BRACING VERTICAL STRUCTURES

CROSS REFERENCE TO RELATED APPLICATION

This application claims priority to, and the benefit of, U.S. Provisional Application No. 63/145,146, filed 3 Feb. 2021, the entire contents and substance of which is hereby incorporated by reference.

BACKGROUND

Utility lines, such as those carrying electrical power, cable television signals, or telephone signals, have traditionally been supported above ground using poles, which are typically wooden. Such poles must be capable of withstanding not only the columnar load applied by the weight of the objects supported thereon but also the transverse or horizontal load imposed by transverse winds or unbalanced wire tensions from angled or dead end wires that cause the upper end of the pole to deflect relative to the buried bottom end of the pole.

After some years in service, wooden utility poles tend to experience decay and rotting just below and/or slightly above ground level. While the decayed region is normally relatively small and the penetration of the decay may be limited, the pole is nonetheless structurally weakened and may not be sufficiently strong to withstand wind and other environmental factors. Under these conditions, wind forces can result in a pole breaking and toppling, sometimes without warning.

Therefore, it can become necessary to replace older wooden poles in a population (e.g., network) of wooden poles. The demand for replacement poles, in combination with the demand for new poles, can be difficult to meet. In addition, this high demand for wooden poles can present environmental concerns related to deforestation and/or any toxic effects of preservative chemicals used to treat the poles. Further, replacement of existing poles can be expensive and may require interruption of service to users of the utility. To overcome these and other problems associated with pole replacement, various methods and apparatus for reinforcing in-service poles have been developed to extend their useful life.

One technique for reinforcing utility poles involves coupling an elongated truss to the pole, thereby creating a splint or bridge across the weakened portion of the pole. Such trusses are customarily adapted to extend at least partway along the pole parallel to the pole's longitudinal axis to provide support against transverse forces (e.g., wind) and other loading conditions.

One such pole reinforcing apparatus is the OSMOSE® Osmo-C-Truss™ system. This truss helps to restore the groundline strength of utility poles at a fraction of the cost of pole replacement. As shown in the leftmost panel of FIG. 1, the Osmo-C-Truss™ system can include a C-shaped galvanized steel reinforcing truss that can be secured to a pole by galvanized steel bands fastened around the perimeter of the truss/pole assembly. The Osmo-C-Truss™ system has been shown to extend the life of a pole for many years and can be installed without interrupting service to utility customers.

In spite of the many advantages of the Osmo-C-Truss™ system, some performance issues can arise due to the use of a C-shaped or channel-shaped reinforcing apparatus. One significant performance issue is related to the ability of a C-shaped or channel-shaped design to withstand bending loads from a pole without twisting or rotating about the pole. One solution in the prior art is to increase the capacity of the apparatus by increasing its dimensions or the yield strength of the material of construction. However, these approaches fail to consider the underlying mechanical principles that govern the performance of such devices under load. Because the shear centers and the elastic axes of the reinforcing apparatus reside well outside the locus of the applied transverse load, there results significant torsional forces acting upon the reinforcing apparatus in addition to the expected bending forces. Specifically, C-shaped or channel-shaped designs do not account for the relationship between the location of the shear center of the truss and the location of the transverse applied load. The further the applied load is from the shear center and elastic axis, the greater the torsional forces that act upon the truss in combination with the bending forces. Torsional forces may cause the truss to shift its position about the circumference of the pole (i.e., rotate about the pole) to a disadvantageous position wherein the truss is no longer loaded in the direction of maximum strength. Further, the reinforcing apparatus itself may twist and experience shape distortion when subjected to torsional forces, causing a reduction in performance; possibly less than the theoretical strength of the material of construction would afford.

Without a corresponding decrease in torsional rotation of the apparatus about the pole, or a reduction in the torsional forces themselves, the increased theoretical resistance to bending forces supplied by a truss having increased dimensions or higher yield material may be of little practical value. In fact, the use of higher strength materials to increase truss capacity is accompanied by a generally proportional increase in the truss rotations and deflections that occur when the truss is loaded beyond the capacity of a similarly-dimensioned truss formed of lower strength material. The reinforced truss will undergo unacceptable rotation or twisting deformation, causing premature failure before its theoretical bending capacity, as determined using the undistorted shape, is reached. Further, while measures such as adding material of higher yield strength may increase theoretical bending support, they represent significant added costs, in many cases without yielding proportionate benefits or expected results.

In an effort to address the problems mentioned above, several improved truss embodiments are described in U.S. Pat. Nos. 6,079,165 and 7,363,752. An embodiment consistent with the disclosure of U.S. Pat. No. 7,363,752 is illustrated in the middle panel of FIG. 1. The embodiments involve various cross-sectional configurations intended to bring the elastic axis and shear center of the open truss section closer to the pole and to the point where load is transferred from the pole to the truss, thereby reducing torsional loading on the truss.

While the truss configurations described in U.S. Pat. Nos. 6,079,165 and 7,363,752 offer improved performance relative to prior trusses, there can still be a tendency for all prior art trusses to rotate about the pole to a position where the load is no longer acting along an intended direction relative to the truss section and is instead acting along a weak axis of the truss section. It has been observed that this problem actually gets worse as higher yield strength steel is used, thereby defeating the purpose of using higher yield steel. At the onset of yielding, there is a tendency for buckling to occur in pole-engaging side flanges of prior art trusses. Consequently, the geometry of the truss cross-section changes, thereby decreasing the effectiveness of the truss and leading to ultimate failure rather rapidly after the onset of first yielding. Generally speaking, prior art trusses have been designed for elastic capacity, and have not been designed to resist buckling. To the extent any prior art trusses are designed to resist buckling, existing designs may not be easily manufacturable, may be difficult to handle or install, and/or may have unnecessarily high cost associated with it (e.g., manufacturing cost, storage cost, installation cost).

Accordingly, there is a need for a pole reinforcement truss that better maintains its cross-sectional geometry after the onset of yielding, provides increased manufacturability, increases the ease of handling and/or installation, and/or decreases cost associated with the truss (e.g., manufacturing cost, storage cost, installation cost).

SUMMARY

These and other problems are addressed by certain aspects and attributes of the disclosed technology. For example, the disclosed technology relates to a truss for reinforcing a pole (e.g., a wooden utility pole, telephone poles, and the like) to increase its useful lifetime and allow it to withstand environmental forces.

The disclosed technology include a truss for reinforcing a pole. The truss can include an elongate body having a pair of opposite ends connected by a pair of longitudinal edges, a first side portion including one of the longitudinal edges, a second side portion including the other of the longitudinal edges, and a center portion connecting the first side portion and the second side portion. The first side portion can include a first substantially straight section and a second substantially straight section, and the first and second substantially straight sections can be separated by a first bend having a first angle that is greater than 45 degrees. The second side portion can include a third substantially straight section and a fourth substantially straight section, and the third and fourth substantially straight sections can be separated by a second bend having a second angle that is greater than 45 degrees.

The first angle and the second angle can both be in a range between approximately 60 degrees and approximately 80 degrees.

The truss can be configured to contact an exterior of the pole via the longitudinal edges. The truss can be configured to contact an exterior of the pole via only the longitudinal edges.

The elongate body can form a hollow interior portion configured to face the pole when the truss is installed.

A length of the first substantially straight section can be approximately equal to a length of the fourth substantially straight section. A length of the second substantially straight section can be approximately equal to a length of the third substantially straight section.

The center portion of the truss can include a fifth substantially straight section, a sixth substantially straight section, and a third bend separating the fifth substantially straight section and the sixth substantially straight section. The third bend can have a third angle. The truss can further include a fourth bend separating the second substantially straight section of the first side portion and the fifth substantially straight section of the center portion, and the fourth bend can have a fourth angle. The truss can further include a fifth bend separating the third substantially straight section of the second side portion and the sixth substantially straight section of the center portion, and the fifth bend can have a fifth angle.

A length of the fifth substantially straight section can be approximately equal to a length of the sixth substantially straight section.

The third angle can be in a range between approximately 5 degrees and approximately 25 degrees.

The fourth angle and the fifth angle can both be in a range between approximately 60 degrees and approximately 80 degrees.

The first bend, the second bend, the fourth bend, and the fifth bend can have a common radius.

The disclosed technology includes a foundation plate for reinforcing a pole. The foundation plate can be configured to attach to the pole at an underground location when the pole is embedded in the ground. The foundation plate can include a first portion, a second portion, a third portion, and a fourth portion. The foundation plate can also include one or more apertures extending through foundation plate. The first portion can form a first flange, and the fourth portion can form a second flange. The second portion can extend from the first portion at a first angle, and the third portion can extend from the fourth portion at a second angle.

A length of the first portion can be approximately equal to a length of the fourth portion. A length of the second portion can be approximately equal to a length of the third portion.

The first angle can be approximately equal to the second angle.

The second portion and the third portion can intersect to form a third angle.

The disclosed technology includes a pole reinforcement system. The pole reinforcement system can include a truss as described herein and one or more bands configured to attach the truss to a pole. The pole reinforcement system can include a foundation plate as described herein, and the foundation plate can be attachable to the pole at an underground location on the pole. Alternatively or in addition, the truss can include a fin extending outwardly from an outer surface of the truss, and the fin can be located at an underground location on the truss when the truss is installed on the pole.

Other examples, embodiments, features, and aspects of the disclosed technology are described in detail herein and are considered a part of the claimed disclosed technology. Other embodiments, features, and aspects can be understood with reference to the following detailed description, accompanying drawings, and claims.

BRIEF DESCRIPTION OF THE FIGURES

Reference will now be made to the accompanying figures and flow diagrams, which are not necessarily drawn to scale, and wherein.

DETAILED DESCRIPTION

The disclosed technology includes a truss for reinforcing a pole. As disclosed herein the truss can reinforce a pole (e.g., a wooden utility pole, telephone poles, and the like) to increase its useful lifetime and allow it to withstand environmental forces. For example, a truss in accordance with the disclosed technology can be attached to a damaged utility pole to create a splint or bridge across the weakened portion of the pole, thereby providing a secure vertical structure without requiring replacement of the pole and without removing the pole from service.

Aspects of the disclosed technology will be described more fully hereinafter with reference to the accompanying drawings. This disclosed technology can, however, be embodied in many different forms and should not be construed as limited to the examples set forth therein.

In the following description, numerous specific details are set forth. However, it is to be understood that various examples of the disclosed technology can be practiced without these specific details. In other instances, well-known methods, structures, and techniques have not been shown in detail in order to not obscure an understanding of this description. References to "one embodiment," "an embodiment," "example embodiment," "some embodiments," "certain embodiments," "various embodiments," "one example," "an example," "some examples," "certain examples," "various examples," etc., indicate that the example(s) of the disclosed technology so described can include a particular feature, structure, or characteristic, but not every implementation of the disclosed technology necessarily includes the particular feature, structure, or characteristic.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

As used herein, the term "pole" includes various forms and definitions of elongated support members (e.g., posts, pilings), whether or not constructed of wood.

Unless otherwise specified, any range of values provided herein is inclusive of its endpoints. For example, the phrases "between 4 and 6" and "from 4 to 6" both indicate a range of values that includes 4, 6, and all values therebetween.

Various systems, apparatuses, and methods are disclosed herein for reinforcing, and increasing the structural integrity of, a pole.

Figure 1:
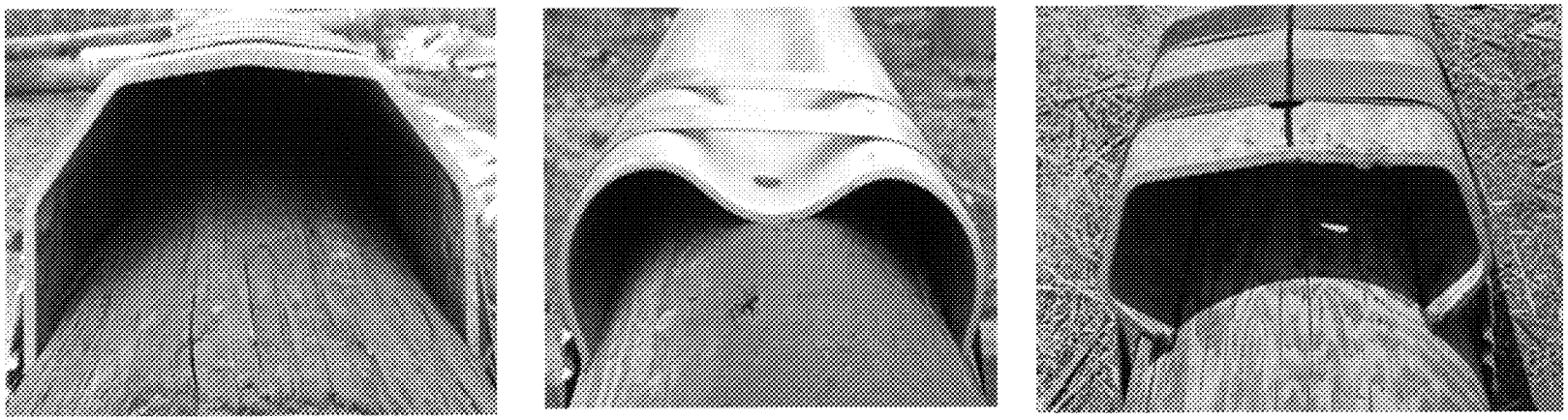
FIG. 1 illustrates a comparison view of prior art trusses and an example truss in accordance with the disclosed technology.

As shown in FIG. 1, existing truss designs include a C-shaped or channel-shaped design (e.g., as shown in leftmost panel) and a design including multiple curved portions to form a general M-shape (e.g., as shown in middle panel). The technology disclosed herein includes the truss 100 illustrated in the rightmost panel of FIG. 1.

The disclosed truss 100 can provide several benefits over existing truss designs. For example, the truss 100 can provide increased strength to weight efficiency, which can increase material efficiency and decrease manufacturing costs, and/or can increase the weak to strong axis bending capacity ratio. Alternatively or in addition, the truss 100 can have a general cross-sectional shape that permits a single truss to fit an increased range of pole sizes and/or diameters. For example, the truss 100 does not necessarily require a taper if the truss is particularly long (e.g., for taller poles), as is typically required for existing truss designs. This can enable upgrade solutions, which can also act in a restorative capacity if decay is present in the pole. The general cross-sectional shape of the truss 100 also enables the truss 100 be put under pretension such that the truss is "spring loaded," which has the benefit of maintaining banding tension following installation of the truss 100 on a pole. Moreover, the truss 100 can provide an increased projected surface area than previous designs, which can improve foundation capacity. Further, because the profile of the truss 100 bends inward and can therefore fit on smaller poles, stronger trusses can be used to upgrade poles to higher bending capacities, and a truss can be installed to a height above ground that can upgrade the class equivalent of the pole (see, e.g., FIGS.

5A-5C). Further still, the profile and general geometry of the truss 100 enables the truss 100 to accommodate a greater range of pole sizes (e.g., pole diameters), increasing the usefulness of a single truss size and decreasing the number of truss sizes required to accommodate all necessary pole sizes. These and other benefits will become apparent to one having skill in the art.

Figure 2A:
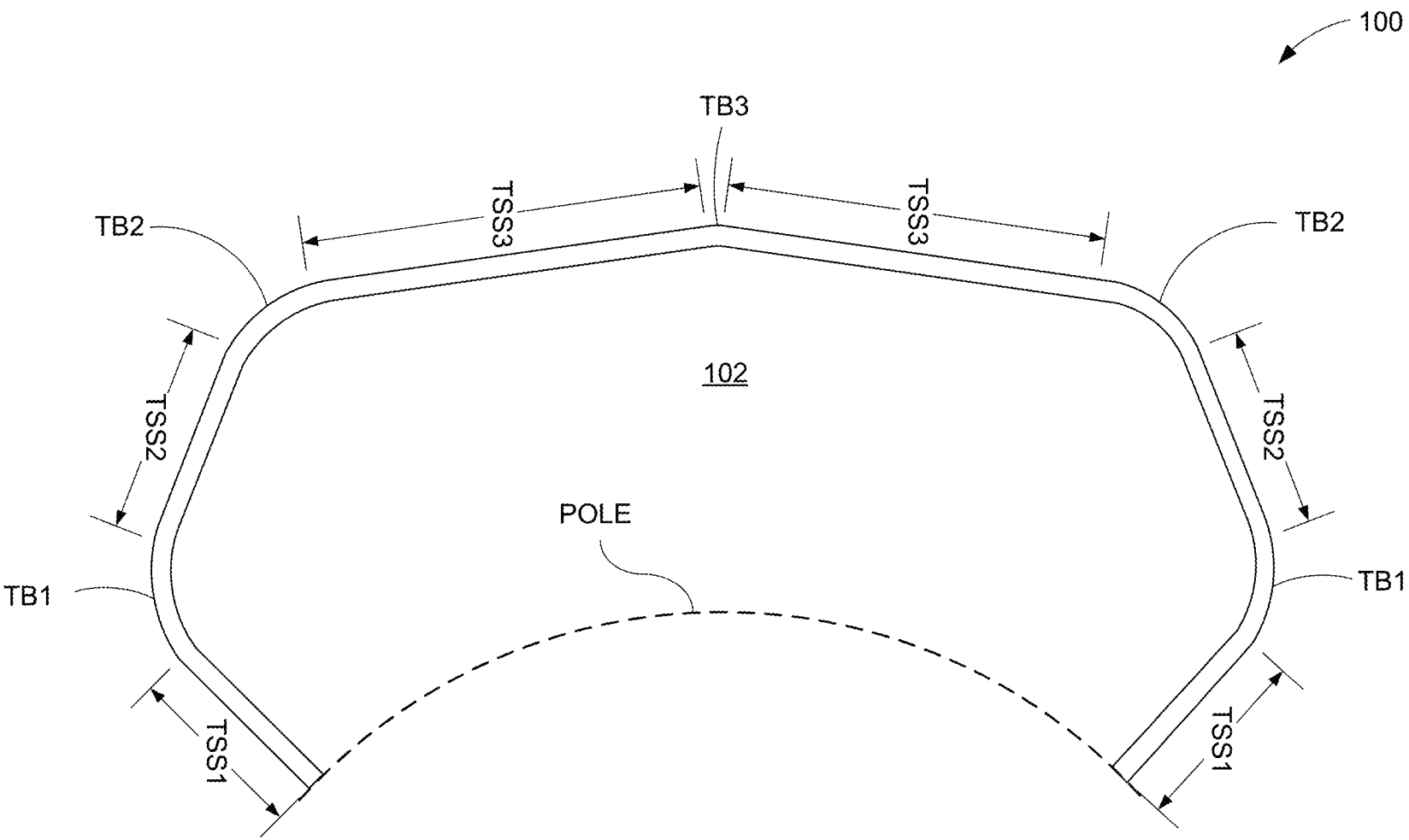
FIG. 2A illustrates a cross-sectional view of an example truss, in accordance with the disclosed technology.
Figure 2B:
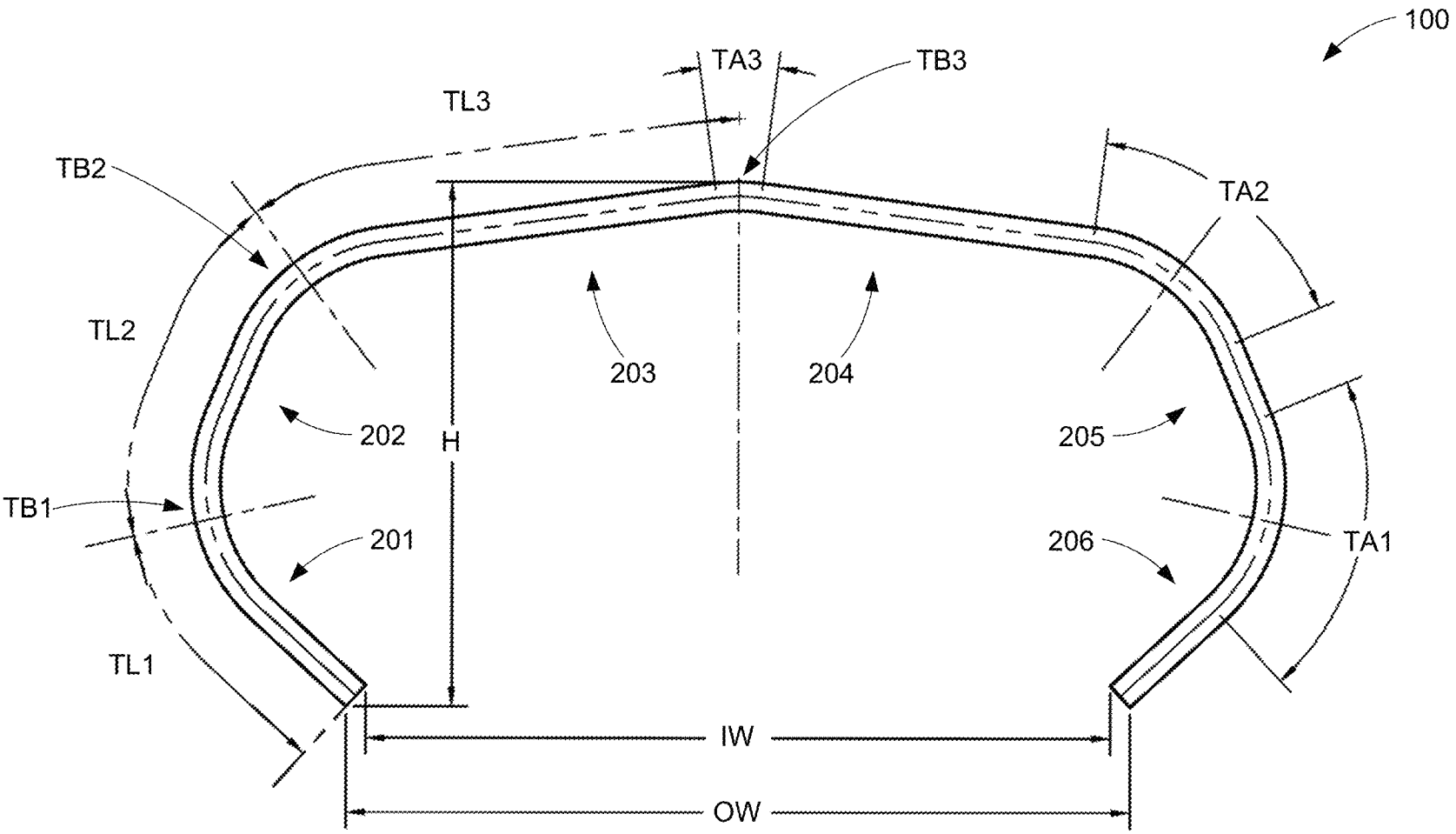
FIG. 2B illustrates a cross-sectional view of the example truss, in accordance with the disclosed technology.

Referring now to FIGS. 2A and 2B, the truss 100 can have a cross-sectional shape that defines a hollow interior portion 102. The cross-sectional shape 102 of the truss 100 can extend along the entire length of the truss 100. That is, the truss 100 can have a substantially consistent cross-sectional shape. Alternatively, one or more portions of the truss 100 can have a cross-sectional shape different from that shown in FIGS. 2A and 2B. Alternatively or in addition, the dimensions of the truss 100 can be constant along the length of the truss 100, or the dimensions of the truss 100 can change along one or more sections of the length of the truss 100. For example, the truss 100 can taper (e.g., the general cross-sectional shape and/or the cross-sectional dimensions of the truss 100 can change along the length of the truss 100).

The truss 100 can include opposing side portions that are on either side of a central portion. Each side portion can include two straight sections. The central portion can include two straight sections. Each straight section can be separated by a bend. The truss 100 can be symmetrical such that the central portion is symmetrical and either side portion is a mirror image of the opposite side portion. More specifically, the truss 100 can include a first straight section TSS1, a second straight section TSS2, and a third straight section TSS3. The first straight section TSS1, second straight section TSS2, third straight section TSS3 can be substantially straight (i.e., not necessarily perfectly "straight"). The first straight section TSS1 and second straight section TSS2 can be separated by a first bend TB1, and the second straight section TSS2 and the third straight section TSS3 can be separated by a second bend TB2. As mentioned, the truss 100 can be symmetrical, such that the third straight section TSS3 of a first half of the truss 100 can be separated by the third straight section TSS3 of a second half of the truss 100 by a third bend TB3. In some instances, the two third straight sections TSS3 and the third bend TB3 can be referenced communally as a center portion of the truss 100. Each first bend TB1 can have the same radius, each second bend TB2 can have the same radius, and/or each third bend TB3 can have the same radius. One, some, or all of the various bends TB1, TB2, TB3 can have a different radius. Alternatively, some or all of the various bends TB1, TB2, TB3 can have the same radius. For example, each bend TB1, TB2, TB3 can have an approximately 1.0-inch radius.

As shown most clearly in FIG. 2B, the truss 100 can include six portions, with each portion extending between (i) respective midlines of adjacent bends or (ii) an end of the truss 100 and the midline of the nearest bend. That is, a first portion 201 can be defined as extending between an end of the truss 100 and the centerline of the first bend TB1, a second portion 202 can be defined as extending between the centerline of the first bend TB1 and the centerline of the second bend TB2, and a third portion 203 can be defined as extending between the centerline of the second bend TB2 and the centerline of the third bend TB3. These portions can be mirrored on the opposite half of the truss 100 (i.e., a fourth portion 204 mirroring the third portion 203, a fifth portion mirroring the second portion 202, and a sixth portion mirroring the first portion 201). Each portion can have a corresponding length as measured along a center line of the truss 100. That is the first portion 201 (and sixth portion 206) can have a first length TL1, the second portion 202 (and fifth portion 205) can have a second length TL2, and the third portion 203 (and fourth portion 204) can have a third length TL3. As non-limiting examples, the lengths TL1, TL2, TL3 can have dimensions as provided in Table 1 (again, as measured along the centerline of the truss 100). Thus, as non-limiting examples, the ratios between these lengths (TL1:TL2:TL3) can be approximately 10:11:18, approximately 8:10:15, approximately 5:6:10, approximately 9:10:17, approximately 7:9:14, or approximately 12:14:23.

TABLE 1

| | Ex. 1 | Ex. 2 | Ex. 3 | Ex. 4 | Ex. 5 | Ex. 6 |
|---|---|---|---|---|---|---|
| TL1 (in.) | 2.5 | 2 | 2.5 | 2.25 | 1.75 | 1.5 |
| TL2 (in.) | 2.75 | 2.5 | 3 | 2.5 | 2.25 | 1.75 |
| TL3 (in.) | 4.5 | 3.75 | 5 | 4.25 | 3.5 | 2.875 |

Each bend TB1, TB2, TB3 can have a bend angle in a corresponding angle range. For example the first bend TB1 can have a first angle TA1 from a first angle range, the second bend TB2 can have a second angle TA2 from a second angle range, and the third bend TB3 can have a third angle TA3 from a third angle range. The first angles TA1 and second angles TA2 can be greater than 45 degrees. As non-limiting examples, the first angle range can be between approximately 60 degrees and approximately 80 degrees, the second angle range can be between approximately 50 degrees and approximately 70 degrees, and the third angle range can be between approximately 5 degrees and approximately 25 degrees. As a more specific example, the first angle TA1 can be approximately 70 degrees, the second angle TA2 can be approximately 60 degrees, and the third angle TA3 can be approximately 15 degrees. Unless otherwise specified, the angles described herein are measured from the outside of the truss 100 (i.e., from the side of the truss 100 that is opposition the interior portion 102). As mentioned above, the radius of each bend TB1, TB2, TB3 can be approximately 1 inch. Different radii are contemplated by the present disclosure, however. For example, the radius of at least one bend TB1, TB2, TB3 can be in a range between approximately 0.5 inch to approximately 1 inch, and/or the radius of at least one bend TB1, TB2, TB3 can be in a range between approximately 1 inch and 1.5 inches. The various bends TB1, TB2, TB3 can have the same radius. Alternatively, one, some, or all of the various bends TB1, TB2, TB3 can have different radii. Optionally, the various dimensions and angles of the truss 100 can result in the ends of the truss's 100 (as view in cross section) as being perpendicular to the tangential edge of a particularly sized pole at installation (see, e.g., FIG. 2A).

The geometry of the truss 100 can be such that the open end of the truss 100 has two widths: an inner width IW and an outer width OW. The inner width IW can correspond to the inner surface of the truss material, and the outer width OW can correspond to the outer surface of the truss material. As a non-exclusive example, the inner width IW can be approximately 4.8 inches, and the outer width OW can be approximately 5.0 inches. As additional examples, the inner width IW can be in a range between approximately 2.0 inches and approximately 4.0 inches, a range between approximately 4.0 inches and approximately 6.0 inches, a range between approximately 6.0 inches and approximately 8.0 inches, a range between approximately 8.0 inches and approximately 10.0 inches, or a range between approximately 10.0 inches and approximately 12.0 inches. Alternatively or in addition, the outer width OW can be in a range between approximately 2.0 inches and approximately 4.0 inches, a range between approximately 4.0 inches and approximately 6.0 inches, a range between approximately 6.0 inches and approximately 8.0 inches, a range between approximately 8.0 inches and approximately 10.0 inches, or a range between approximately 10.0 inches and approximately 12.0 inches. Further the truss 100 can have a height H. As a non-exclusive example, the height H can be approximately 3.4 inches. As additional examples, the height H of the truss 100 can be in a range between approximately 1.0 inch and approximately 2.0 inches, a range between approximately 2.0 inches and approximately 3.0 inches, a range between approximately 3.0 inches and approximately 4.0 inches, a range between approximately 4.0 inches and approximately 5.0 inches, a range between approximately 6.0 inches and approximately 6.0 inches, or a range between approximately 6.0 inches and approximately 7.0 inches.

Figure 2C:
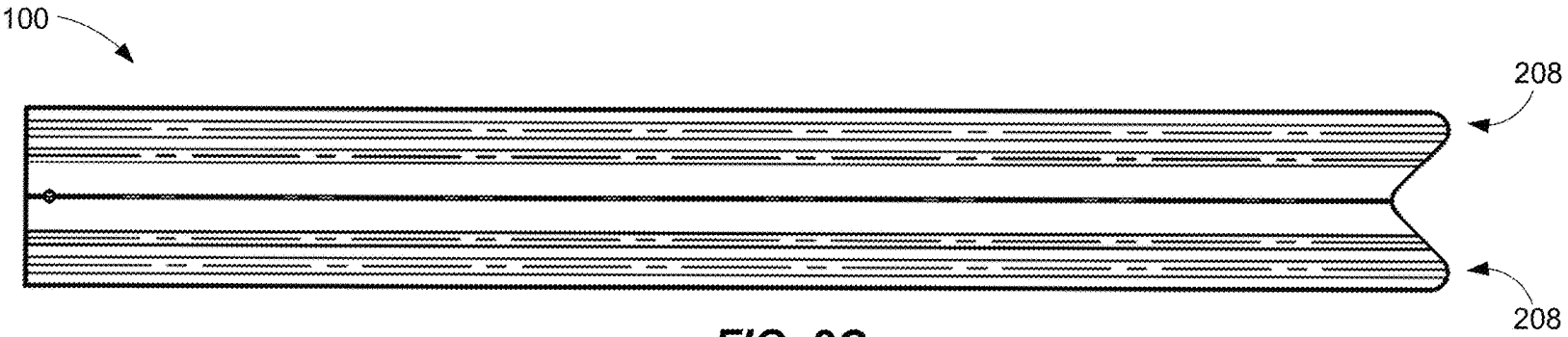
FIG. 2C illustrates a front view of an example truss having a bottom end that includes points, in accordance with the disclosed technology.
Figure 2E:
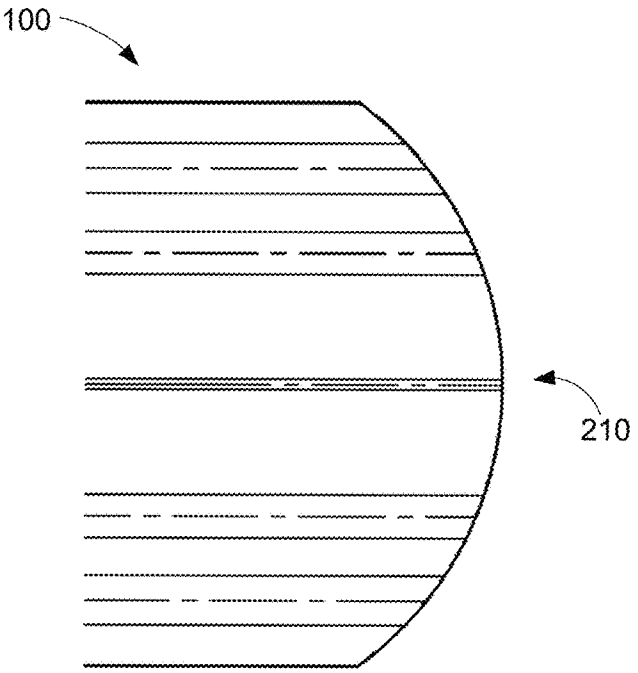
FIG. 2E illustrates a magnified view of a bottom end of a truss that includes a rounded edge, in accordance with the disclosed technology.
Figure 2D:
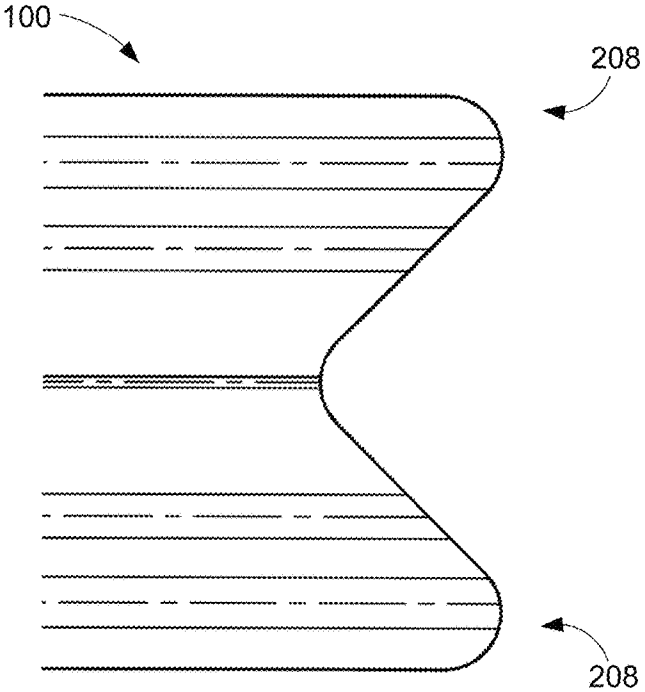
FIG. 2D illustrates a magnified view of a bottom end of a truss that includes points, in accordance with the disclosed technology.

As shown in FIGS. 2C and 2D, the truss 100 can have one or more points 208 at a bottom end of the truss 100. Each point 208 can have two edges extending therefrom such that each point 208 can a V-like shape. A first point 208 can have an edge that meets or intersects an edge of a second point 208 such that the space between the two adjacent points 604 forms an inverse V-like shape. Alternatively, the bottom end of the truss 100 can have a different shape, such as a rounded edge 210, as illustrated in FIG. 2E.

Stated otherwise, the bottom end of the truss 100 can have a geometry such that the bottom end of the truss 100 can act as a spade or shovel blade and is configured to drive into the soil for ease of installation and/or for forcing the truss 100 into the exterior surface of the pole as the truss 100 is driven downward. That is to say, the truss 100 can be installed on an in-service pole that is already installed. As will be described more fully herein, the geometry of the truss 100 (e.g., a taper or angled nature of the truss 100) can be such that, as a downward force is applied to the top edge of the truss 100, the truss 100 moves downwardly into the ground but also toward the pole (i.e., in a direction that is radially inward relative a central axis of the pole). Alternatively or in addition, the truss 100 can be configured to be installed on a pole prior to the pole being installed.

Figure 3:
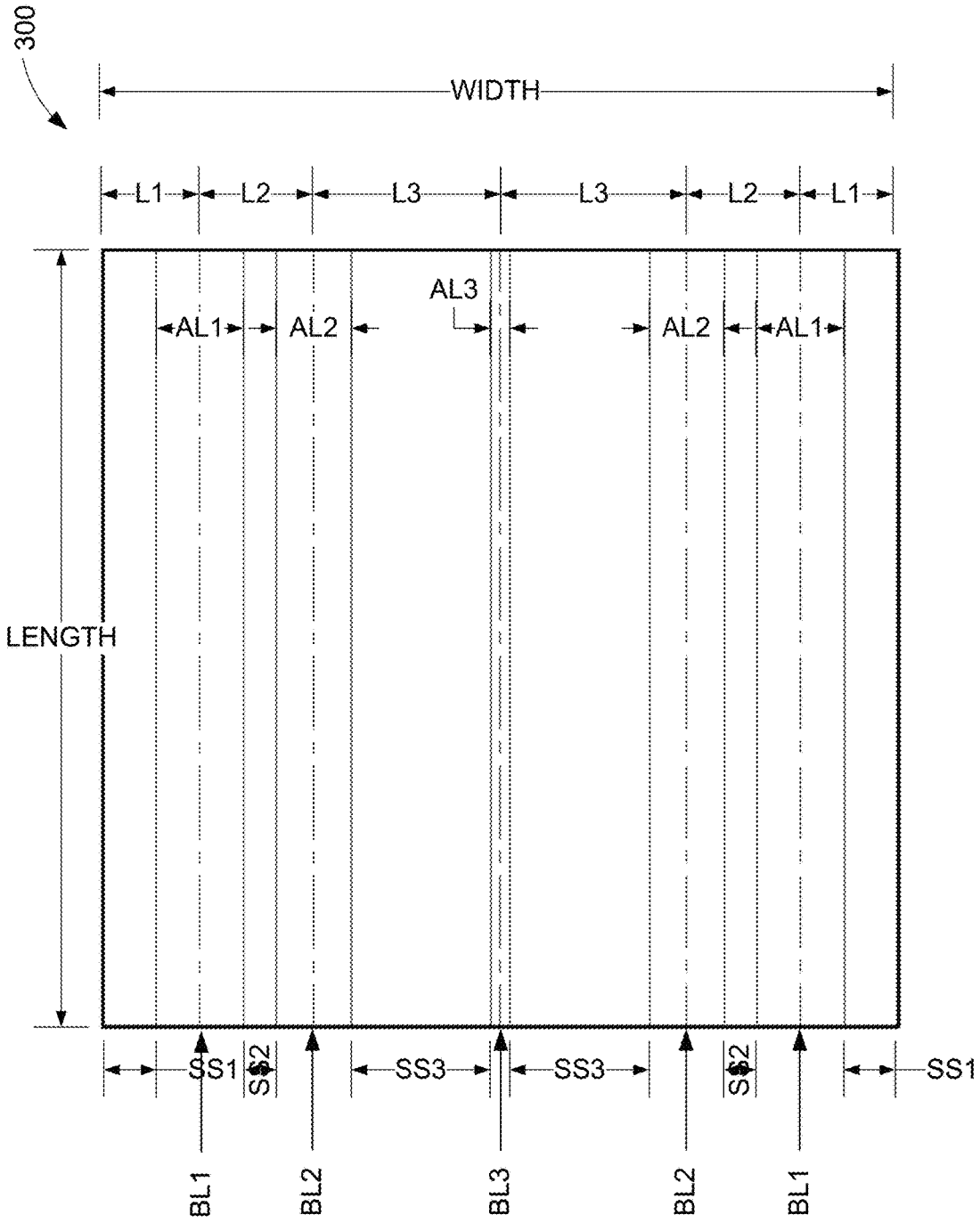
FIG. 3 illustrates a sheet of material prior to being formed into a truss, in accordance with the disclosed technology.

FIG. 3 illustrates a piece of material or a blank 300 that can be formed into the truss 100. The blank 300 can have a generally rectangular shape (if the resulting truss 100 is intended to have a constant, non-tapering cross-section). FIG. 3 details the location of several features that, upon bending, will correspond to the various elements of the truss 100 as described herein. For example, FIG. 3 illustrates two instances of a first bend line BL1, which can correspond to the center lines of the two first bends TB1. Likewise, FIG. 3 illustrates two instances of a second bend line TBL2, which can correspond to the center lines of the two second bends TB2. Finally, FIG. 3 illustrates a single third bend line TBL3, which can correspond to the third bend B3. Each bend line is shown between a pair of solid lines, and each of these corresponding solid lines can be indicative of the edges of each corresponding bend TB1, TB2, TB3, thereby denoting the arc length of each respective bend. That is, either first bend TB1 can have a first arc length TAL1, either second bend TB2 can have a second arc length TAL2, and the third bend TB3 can have a third arc length TAL3. FIG. 3 also illustrates the first straight sections TSS1, second straight sections TSS2, and third straight sections TSS3. In addition, FIG. 3 shows two first lengths TL1 (which can correspond to the first portion 201 and sixth portion 206), two second lengths TL2 (which can correspond to the second portion 202 and fifth portion 205), and two third length TL3 (which can correspond to the third portion 203 and fourth portion 204). As can be seen, each portion of the truss 100 extends between (i) a pair of bend lines TBL1, TBL2, TBL3 or (ii) a bend line TBL1 and an end of the blank. As will be understood, the sum of all lengths TL1, TL2, TL3 can equal the sum of the lengths of all straight sides TSS1, TSS2, TSS3 and all arc lengths TAL1, TAL2, TAL3. Similarly, the width of the blank 300 can correspond to the sum of the lengths of all straight sides TSS1, TSS2, TSS3 and all arc lengths TAL1, TAL2, TAL3.

Figure 5C:
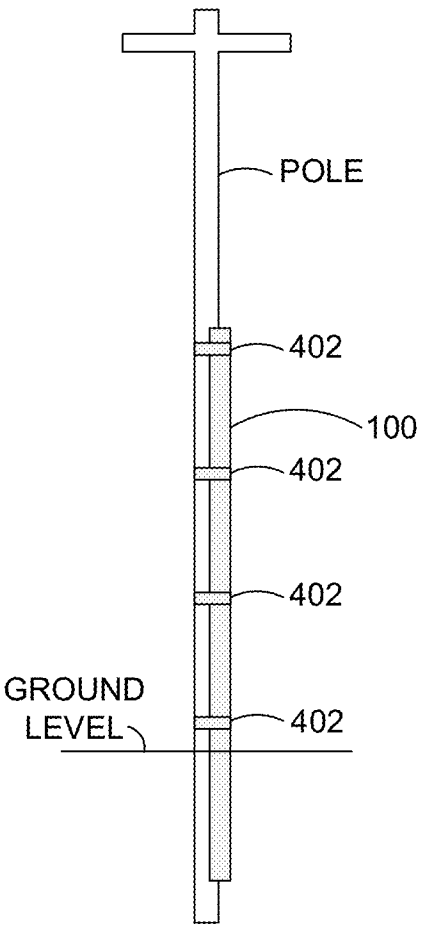
FIG. 5C illustrates a combined above-ground and below-ground view of a truss having a third length and attached to a pole, in accordance with the disclosed technology.
Figure 5B:
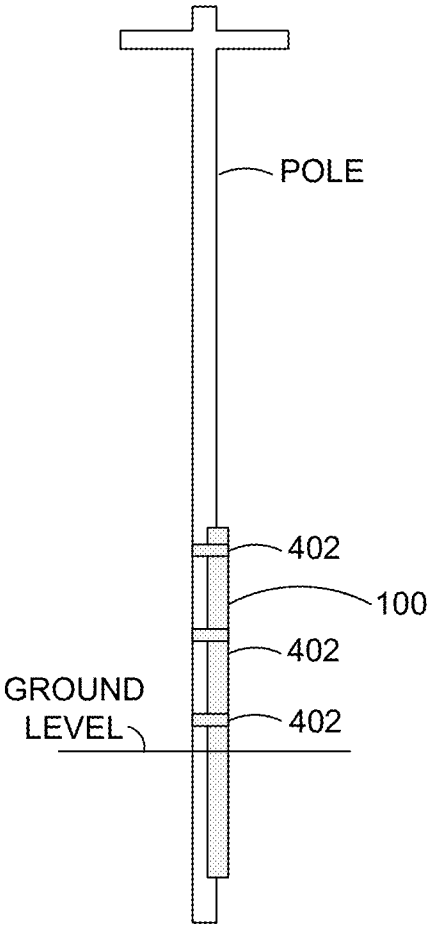
FIG. 5B illustrates a combined above-ground and below-ground view of a truss having a second length and attached to a pole, in accordance with the disclosed technology.
Figure 5A:
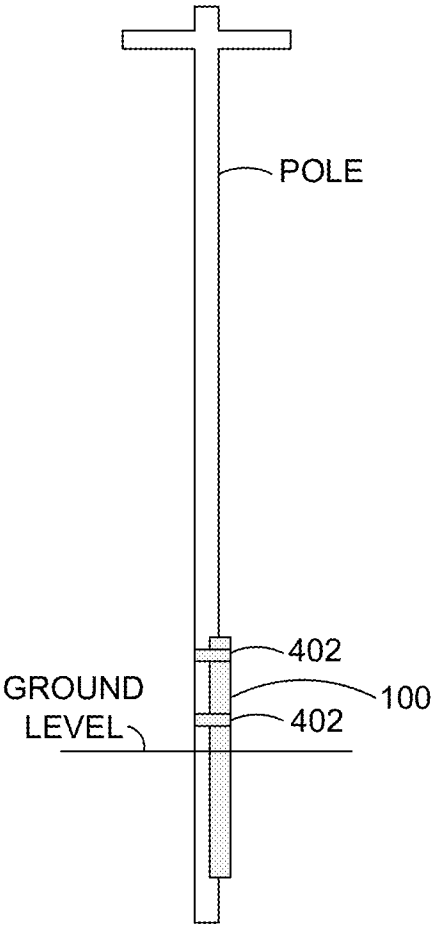
FIG. 5A illustrates a combined above-ground and below-ground view of a truss having a first length and attached to a pole, in accordance with the disclosed technology.

The length of the blank 300 can correspond to a length of the resulting truss 100. Stated otherwise, the length of the blank 300 and resulting truss 100 can correspond to the distance the truss 100 extends along a pole when the truss 100 is installed on the pole. As shown in FIGS. 5A-5C, the blank 300 and the resulting truss 100 can be of different lengths, depending on the desired scenario and/or application. For example, the truss 100 can have a first length (e.g., as illustrated in FIG. 5A), a second length (e.g., as illustrated in FIG. 5B), or a third length (e.g., as illustrated in FIG. 5C), with the second length being greater than the first length and the third length being greater than the second length. The first length can be configured to restore a core strength of the pole at groundline (i.e., ground level). The second length can be configured to restore the core strength of the pole at groundline and provide increased capacity to the pole (i.e., a load capacity that is greater than the original load capacity of the pole when newly installed). The third length can be configured to restore the core strength of the pole at groundline and provide an even more increased capacity to the pole (i.e., a load capacity that is greater than the original load capacity of the pole when newly installed and that is greater than the load capacity associated with the second length). As will be appreciated, a particular length for a specific application or pole location can be based at least in part on a current or anticipated load of the pole, anticipated shear and/or bending forces (e.g., associated with wind or other elements), and/or a current health status of the pole (e.g., a degradation severity of the pole).

The material (of the blank 300 and/or the truss 100) can have any desired thickness. As a non-limiting example, the thickness can be between approximately 3/16 inch and approximately 5/16 inch. The material can be steel (e.g., 100 ksi steel) or any other material capable of handling the desired stresses incident on the pole and/or truss 100.

Figure 4:
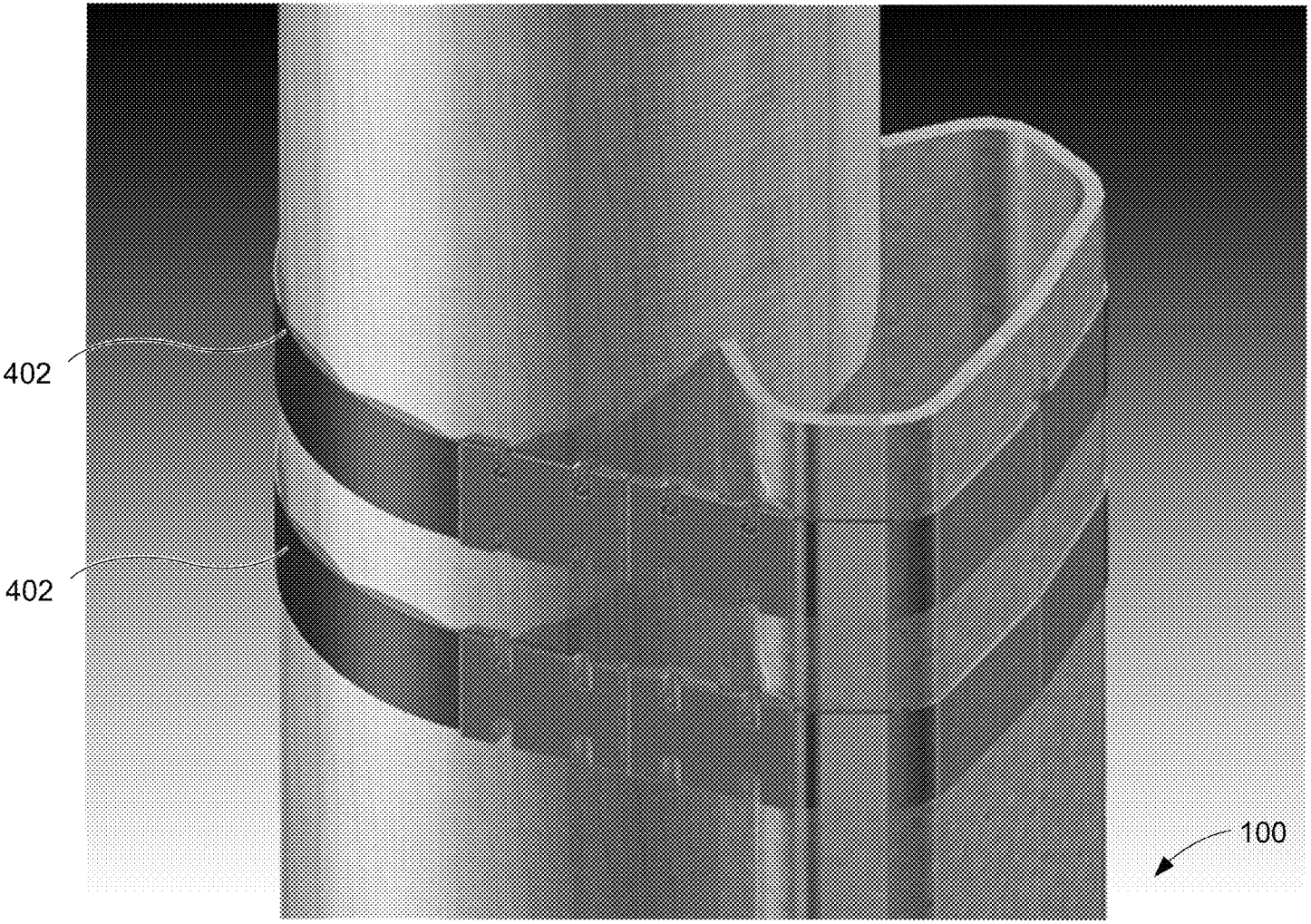
FIG. 4 illustrates an example truss attached to a pole, in accordance with the disclosed technology.

FIG. 4 illustrates a view of the truss 100 attached to a pole using bands 402. The truss 100 can be pretensioned such that the truss 100 is "spring loaded." This can maintain tension against the bands 402 to help prevent the bands from loosening over time, which can help prevent movement of the truss 100 relative the pole. While FIG. 4 depicts two bands 402 and FIG. 5 depicts four total bands 402, any number of bands 402 can be used to attach the truss 100 to the pole. Alternatively or in addition, the truss 100 can be attached to the pole using bolts, screws, or other fasteners.

Figure 6A:
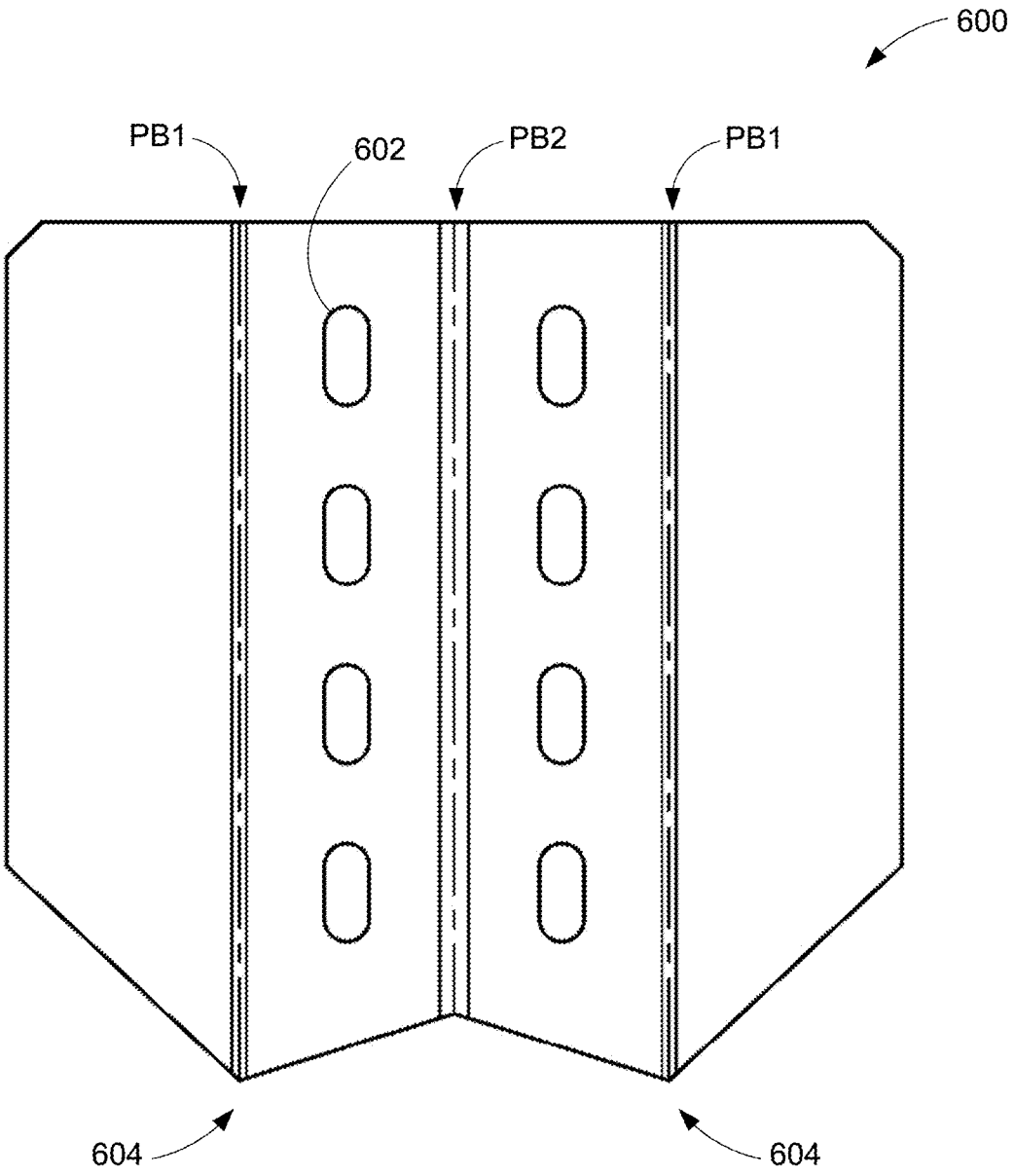
FIG. 6A illustrates front view of an example foundation plate, in accordance with the disclosed technology.
Figure 6B:
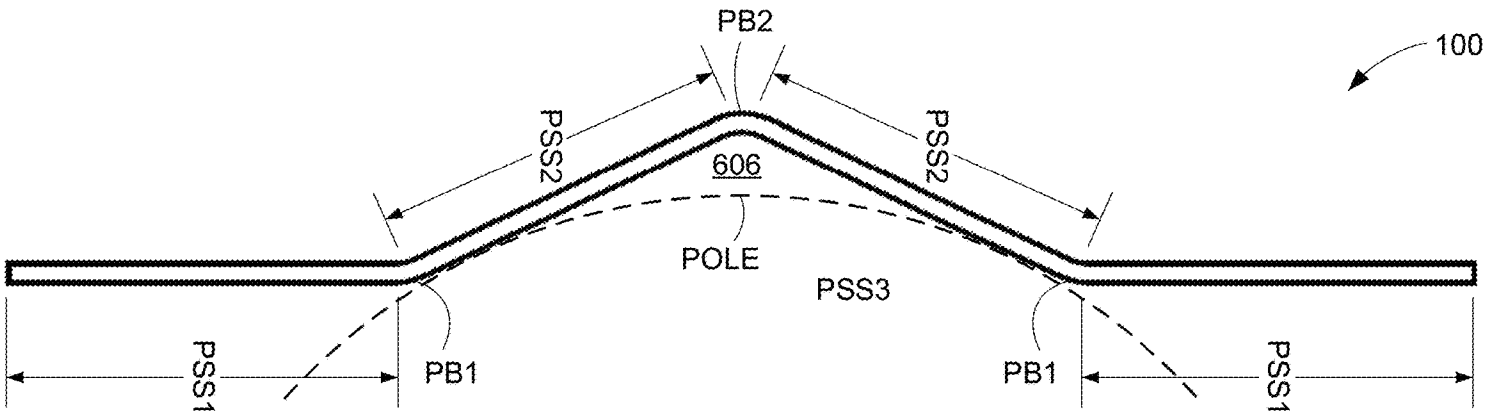
FIG. 6B illustrates a cross-sectional view of the example foundation plate, in accordance with the disclosed technology.
Figure 6C:
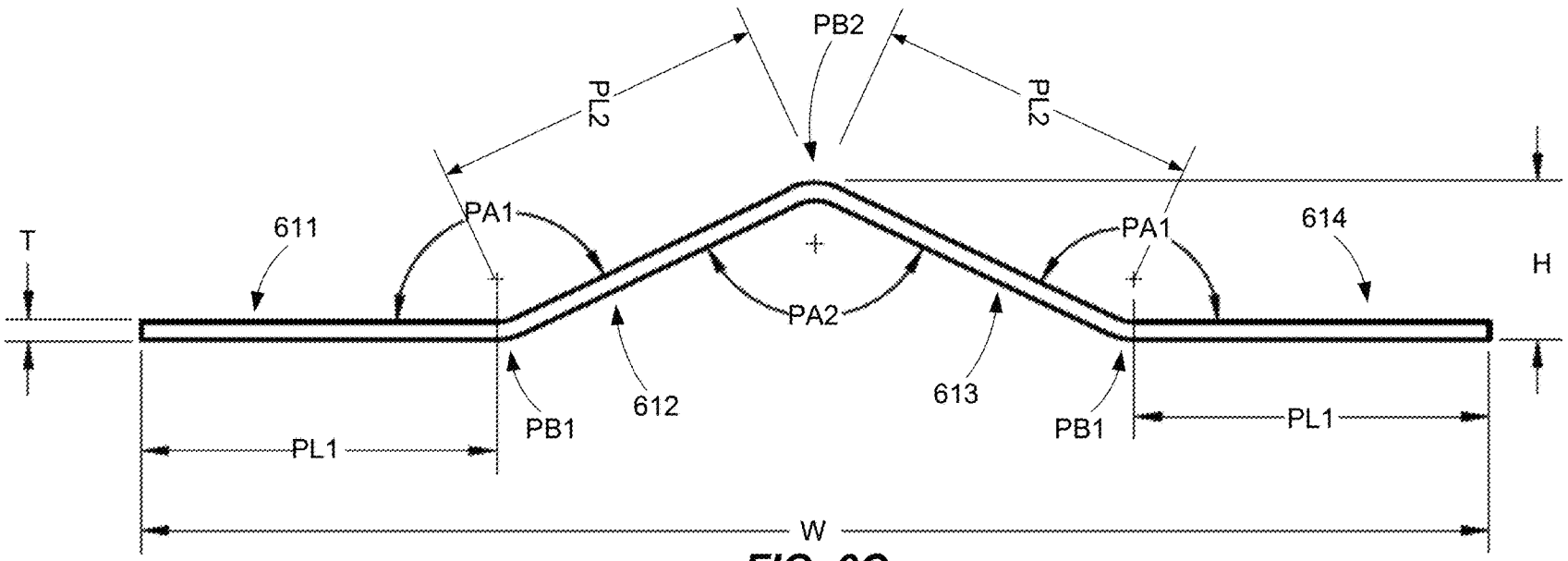
FIG. 6C illustrates a cross-sectional view of the example foundation plate, in accordance with the disclosed technology.

Referring now to FIGS. 6A-6C, the disclosed technology include a foundation plate 600. As will be appreciated by those having skill in the art, certain poles can undergo a constant (or substantially constant) load in a transverse direction. Such loads can be, at least in part, due to slack spans, light line angles without guying, or unguyed dead-ends. Regardless, such poles can, in some instances, lean over time due to such loads and/or other forces (e.g., wind). The foundation plate 600 can alleviate such issues by providing additional stabilization to the pole and/or foundational resistance to transverse loads.

Moreover, pole setting augers, which are generally used to set poles, typically create a hole that is several inches larger in diameter than the pole itself. Depending on the backfill material and/or the procedure for tamping the backfill material, the backfill material (which is located between the outer surface of the pole and the inner surfacer of the augured hole) can provide a relatively weak soil resistance due to, for example, weaker compaction as compared to the virgin soil before the pole was embedded. This can contribute to and/or expedite an eventual lean of the pole. Moreover, the weakest foundational soil is typically found near the top of the embedment (e.g., from the groundline to a depth between approximately ½ foot and approximately 2 feet).

The foundation plate 600 can be configured to attach to a pole, such as a subterranean location (i.e., below ground level) on the pole. The foundation plate 600 can include one or more slots or apertures 602 (referenced hereon as apertures 602), which can enable the foundation plate 600 to be bolted, strapped, or otherwise attached to the pole. Alternatively or in addition, one or more of the apertures 602 can be used to perform a subsequent inspection and/or remediation of the pole. That is, the apertures 602 can enable a technician to bore an inspection hole into the pole through a given aperture 602, and/or the technician can bore a hole into the pole via an aperture 602 and insert remediating materials (e.g., antimicrobial treatment) into the bored hole.

As shown perhaps most clearly in FIG. 6A, the foundation plate 600 can have one or more points 604 at a bottom end of the foundation plate 600. Each point 604 can have two edges extending therefrom such that each point 604 can a V-like shape. A first point 604 can have an edge that meets or intersects an edge of a second point 604 such that the space between the two adjacent points 604 forms an inverse V-like shape. Alternatively, the bottom end of the foundation plate 600 can have a different shape (e.g., such as a rounded edge similar to the rounded edge 210 of the truss 100 as illustrated in FIG. 2E).

Stated otherwise, the bottom edge of the foundation plate (e.g., each point 604, the rounded edge) can form and/or act as a spade or shovel blade that is configured to drive into the soil for ease of installation and/or for forcing the foundation plate 600 into the exterior surface of the pole as the foundation plate 600 is driven downward. That is to say, the foundation plate 600 can be installed on an in-service pole that is already installed. As will be described more fully herein, the geometry of the foundation plate 600 (e.g., a taper or angled nature of the foundation plate 600) can be such that, as a downward force is applied to the top edge of the foundation plate 600, the foundation plate 600 moves downwardly into the ground but also toward the pole (i.e., in a direction that is radially inward relative a central axis of the pole). Alternatively or in addition, the foundation plate 600 can be configured to be installed on a pole prior to the pole being installed.

The foundation plate 600 can have a cross-sectional shape that defines a hollow interior portion 606. The interior portion 606 (and/or any dimensional symmetry of the foundation plate 600) can help ensure the foundation plate 600 is centered on the pole, which can help ensure secure placement and/or attachment of the foundation plate 600 to the pole. That is to say, the foundation plate 600 can be configured to be positioned next to the pole but without being attached to the pole. Thus, the foundation plate 600 can provide stabilization to the pole without necessarily being attached to the pole.

The cross-sectional shape of the foundation plate 600 can extend along the entire length of the foundation plate 600. Stated otherwise, the foundation plate 600 can have a substantially consistent cross-sectional shape along the length of the foundation plate 600. Alternatively, one or more portions of the truss 100 can have a cross-sectional shape different from that shown in FIGS. 6B and 6C. Alternatively or in addition, the dimensions of the foundation plate 600 can be constant along the length of the foundation plate 600, or the dimensions of the foundation plate 600 can change along one or more sections of the length of the foundation plate 600. For example, the foundation plate 600 can taper (e.g., the general cross-sectional shape and/or the cross-sectional dimensions of the foundation plate 600 can change along the length of the foundation plate 600). As previously mentioned, a taper can help bias the foundation plate 600 toward an already-installed pole upon installation of the foundation plate 600.

The foundation plate 600 can include opposing side portions that are on either side of a center line. Each side portion can include a point 604. Each straight section can be separated by a bend. The foundation plate 600 can be symmetrical such that either side portion is a mirror image of the opposite side portion. More specifically, the foundation plate 600 can include a first straight section PSS1 and a second straight section PSS2. (As used herein, reference identifiers beginning with a "T" refer to an element of the truss 100, whereas reference identifiers beginning with a "P" refer to an element of the foundation plate 600.) The first straight section PSS1 and the second straight section PSS2 can be separated by a first bend PB1. As mentioned, the foundation plate 600 can be symmetrical, such that the second straight section PSS2 of a first half of the foundation plate 600 can be separated by the second straight section PSS2 of a second half of the foundation plate 600 by a second bend PB2. Each first bend PB1 can have the same radius and/or each second bend TB2 can have the same radius. One, some, or all of the various bends PB1, PB2 can have a different radius. Alternatively, some or all of the various bends PB1, PB2 can have the same radius. For example, the bends PB1, PB2 can have a radius in the range between approximately 0.5 inches and approximately 1 inch. As a more specific example, each bend can have an approximately 0.75-inch radius. The various bends PB1, PB2 can have the same radius. Alternatively, one, some, or all of the various bends PB1, PB2 can have different radii.

As shown perhaps most clearly in FIGS. 6B and 6C, the foundation plate 600 can include four portions, with each portion extending between (i) respective midlines of adjacent bends or (ii) an end of the foundation plate 600 and the midline of the nearest bend. That is, a first portion 611 can be defined as extending between an end of the foundation plate 600 and the centerline of the first bend PB1, and a second portion 612 can be defined as extending between the centerline of the first bend PB1 and the centerline of the second bend PB2. These portions can be mirrored on the opposite half of the foundation plate 600 (i.e., a third portion 613 mirroring the second portion 612 and a fourth portion 614 mirroring the first portion 611). The first portion 611 can form a first flange, and the fourth portion 614 can form a second flange. Each portion can have a corresponding length as measured along a center line of the foundation plate 600. That is the first portion 611 (and fourth portion 614) can have a first length PL1, and the second portion 612 (and third portion 613) can have a second length PL2. As non-limiting examples, the first length PL1 and/or the second length PL2 can be in a range between approximately 4 inches and approximately 8 inches. As more specific examples, the first length PL1 can be approximately 6.5 inches and the second length PL2 can be approximately 6 inches.

Each bend PB1, PB2 can have a bend angle in a corresponding angle range. For example, the first bend PB1 can have a first angle from a first angle range, and the second bend PB2 can have a second angle from a second angle range. As non-limiting examples, the first angle range can be between approximately 140 degrees and approximately 170 degrees, and the second angle range can be between approximately 110 degrees and approximately 150 degrees. As a more specific example, the first angle PA1 can be approximately 155 degrees, and the second angle PA2 can be approximately 130 degrees. Unless otherwise specified, the angles described herein are measured from the side the foundation plate 600 indicated in FIG. 6C. That is to say, the first angle is measured from the outer-facing side of the foundation plate 600 (when the foundation plate is installed on a pole), and the second angle PA2 is measured from the pole-facing side of the foundation plate 600.

The first portion 611 and the fourth portion 614 can be substantially parallel, and/or the first portion 611 and the fourth portion 614 can be located on substantially the same plane. The interior portion 606 can have a width that is in a range between approximately 8 inches and approximately 16 inches. As a more specific example, the interior portion 606 can have a width that is in a range between approximately 11 inches and approximately 13 inches. As an even more specific example, the width of the interior portion 606 can be approximately 12 inches. Further, the foundation plate 600 can have a height H. As non-exclusive examples, the height H of the foundation plate 600 can be in a range between approximately 1 inch approximately 2 inches, a range between approximately 2 inches and approximately 3 inches, a range between approximately 3 inches and approximately 4 inches, a range between approximately 4 inches and approximately 5 inches, and a range between approximately 5 inches and approximately 6 inches. As a more specific example, the height H of the foundation plate 600 can be approximately 2⅔ inches.

Figure 7:
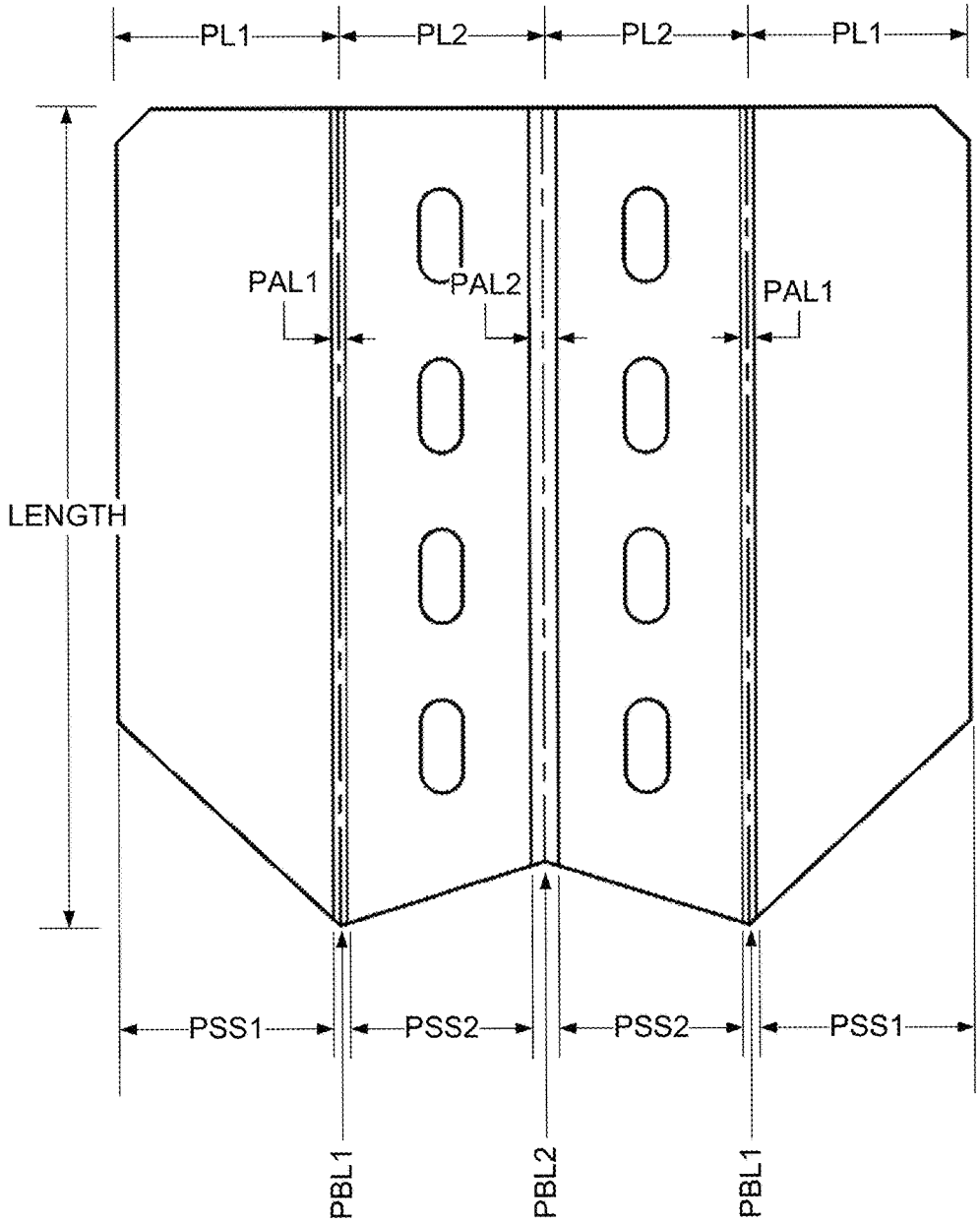
FIG. 7 illustrates a sheet of material prior to being formed into a foundation plate, in accordance with the disclosed technology.

FIG. 7 illustrates a piece of material or a blank 700 that can be formed into the foundation plate 600. The blank 700 can have a generally rectangular shape at one end (e.g., corresponding to the top of the resulting foundation plate 600) and at least one outwardly extending point 604 at the opposite end (e.g., corresponding to the bottom or insertion side of the foundation plate 600). FIG. 7 details the location of several features that, upon bending, will correspond to the various elements of the foundation plate 600 as described herein. For example, FIG. 7 illustrates two instances of a first bend line PBL1, which can correspond to the center lines of the two first bends PB1. Likewise, FIG. 7 illustrates one instance of a second bend line PBL2, which can correspond to the center line of the second bend PB2. Each bend line is shown between a pair of solid lines, and each of these corresponding solid lines can be indicative of the edges of each corresponding bend PB1, PB2, thereby denoting the arc length of each respective bend. That is, either first bend PB1 can have a first arc length PAL1, and the second bend PB2 can have a second arc length PAL2. FIG. 7 also illustrates the first straight sections PSS1 and the second straight sections PSS2. In addition, FIG. 7 shows two first lengths PL1 (which can correspond to the first portion 611 and fourth portion 614) and two second lengths PL2 (which can correspond to the second portion 612 and third portion 613). As can be seen, each portion of the foundation plate 600 extends between (i) a pair of bend lines PBL1, PBL2 or (ii) a bend line PBL1 and an end of the blank. As will be understood, the sum of all lengths PL1, PL2 can equal the sum of the lengths of all straight sides PSS1, PSS2 and all arc lengths PAL1, PAL2. Similarly, the width of the blank 700 can correspond to the sum of the lengths of all straight sides PSS1, PSS2 and all arc lengths PAL1, PAL2.

The length of the blank 700 can correspond to a length of the resulting foundation plate 600. Stated otherwise, the length of the blank 700 and resulting foundation plate 600 can correspond to the distance the foundation plate 600 extends along a pole when the foundation plate 600 is installed on the pole. The blank 700 and the foundation plate 600 can be of different lengths, depending on the desired scenario and/or application. For example, the foundation plate 600 can a length in a range between approximately 16 inches and approximately 40 inches. As a more specific example, the length of the foundation plate 600 can be approximately 20 inches. As will be appreciated, a particular length for a specific application or pole location can be based at least in part on a current or anticipated load of the pole, anticipated shear and/or bending forces (e.g., associated with wind or other elements), the compactness of the foundational soil, or the like.

The material (of the blank 700 and/or the foundation plate 600) can have any desired thickness. As a non-limiting example, the thickness can be between approximately 3/16 inch and approximately ½ inch. As a more specific example, the thickness can be approximately 5/16 inch. The material can be steel (e.g., 100 ksi steel) or any other material capable of handling the desired stresses incident on the pole and/or truss 100.

As illustrated in FIGS. 8A-8D, the foundation plate 600 can be configured to be installed on a pole such that the foundation plate is underground upon installation or embedment of the pole. The number of foundation plates 600 installed on a given pole, and the installation orientation and/or installation location of the foundation plate(s) 600 on the pole can be determined based at least in part on the transverse load experienced by the pole (or the anticipated transverse load). For example, the foundation plate 600 can be installed on a pole such that the direction of the transverse load intersects the plane associated with the first portion 611 and/or fourth portion 614. As another example, the foundation plate 600 can be installed on a pole such that the direction of the transverse load is substantially perpendicular to the plane associated with the first portion 611 and/or fourth portion 614.

Figure 8D:
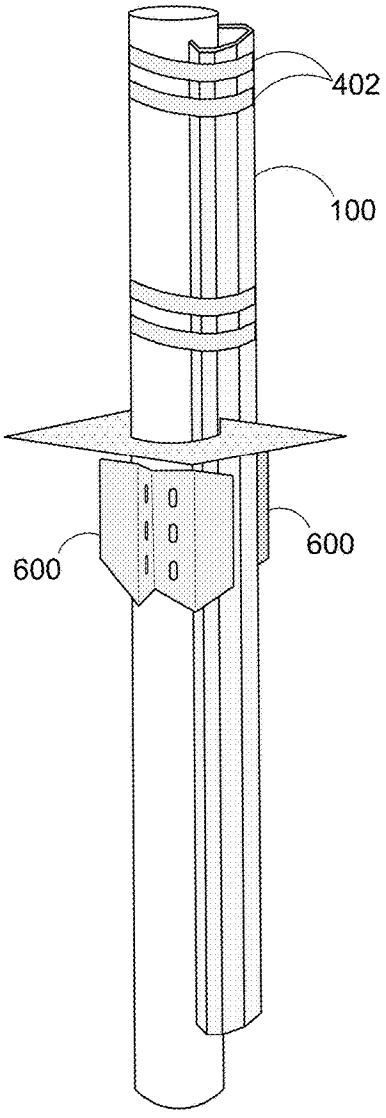
FIG. 8D illustrates a combined above-ground and below-ground view of two example foundation plates and an example truss attached to a pole, in accordance with the disclosed technology.
Figure 8C:
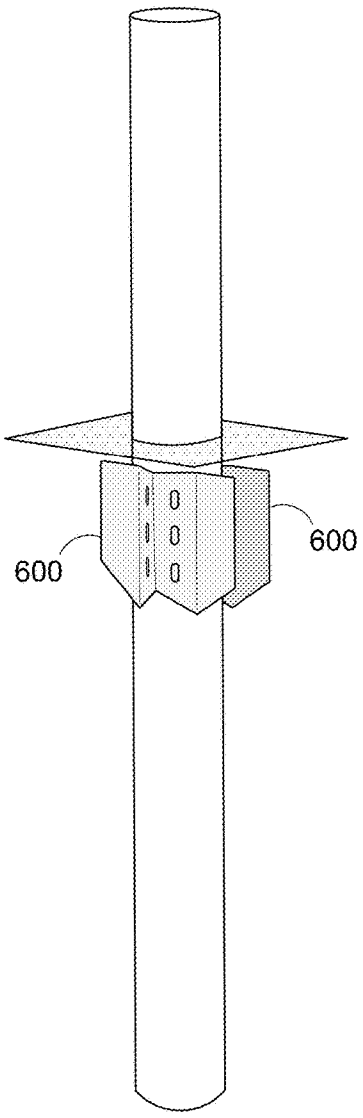
FIG. 8C illustrates a combined above-ground and below-ground view of two example foundation plates attached to a pole, in accordance with the disclosed technology.

Optionally, two foundation plates 600 can be installed (e.g., on opposite sides of the pole) such that the direction of the transverse load intersects (or is substantially perpendicular to) the plane associated with the first portion 611 and/or fourth portion 614. The foundation plates 600 can be installed at substantially the same height along the pole (e.g., as illustrated in FIGS. 8C and 8D). Alternatively, the foundation plates 600 can be installed at different heights along the pole, such that the foundation plates 600 are located at different depths upon installation or embedment of the pole. While the drawings illustrate configurations in which one or two foundation plates 600 are installed, the disclosed technology is not so limited. For example, multiple foundation plates 600 can be installed such that the fourth portion 614 of a first foundation plate 600 intersects or overlaps the first portion 611 of a second foundation plate 600 (e.g., with the second foundation plate 600 being located at a depth that is different from the depth of the first foundation plate 600).

Figure 8B:
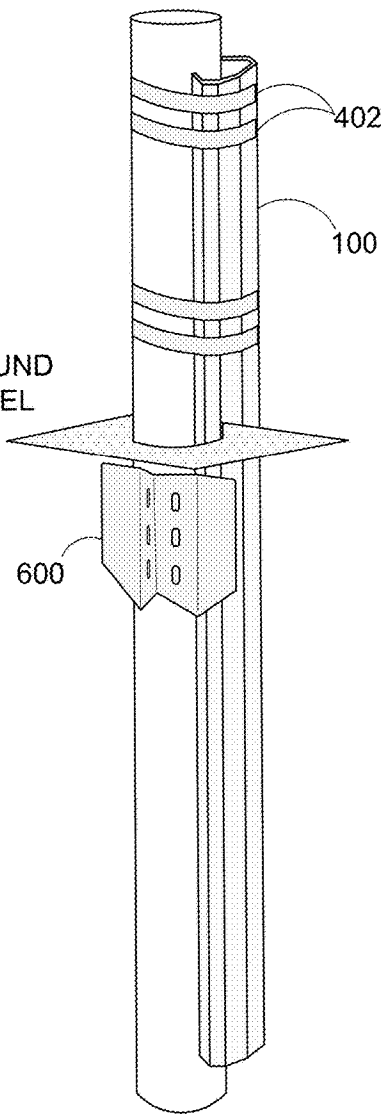
FIG. 8B illustrates a combined above-ground and below-ground view of an example foundation plate and an example truss attached to a pole, in accordance with the disclosed technology.
Figure 8A:
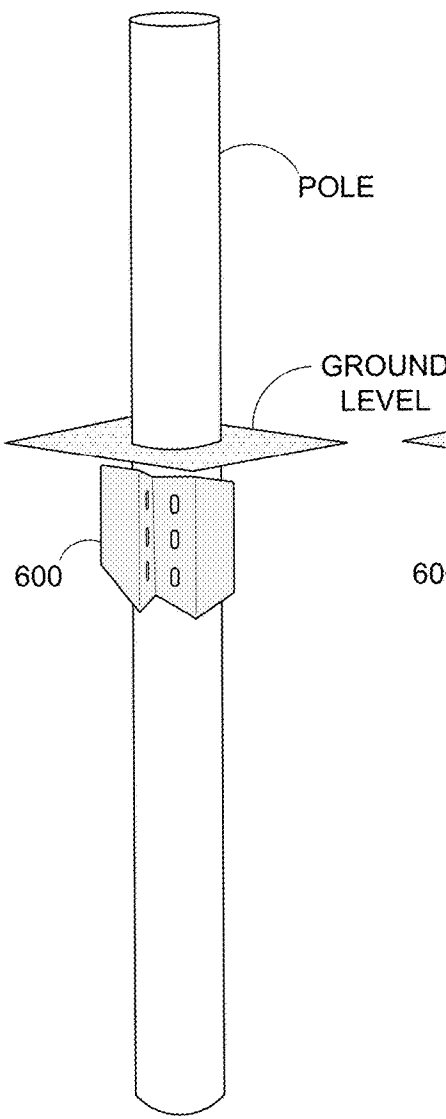
FIG. 8A illustrates a combined above-ground and below-ground view of an example foundation plate attached to a pole, in accordance with the disclosed technology.

As shown in FIGS. 8B and 8D, the foundation plate 600 can be used in conjunction with the truss 100. As such, the disclosed technology can substantially increase the foundational strength and the core strength of the pole.

Figure 9:
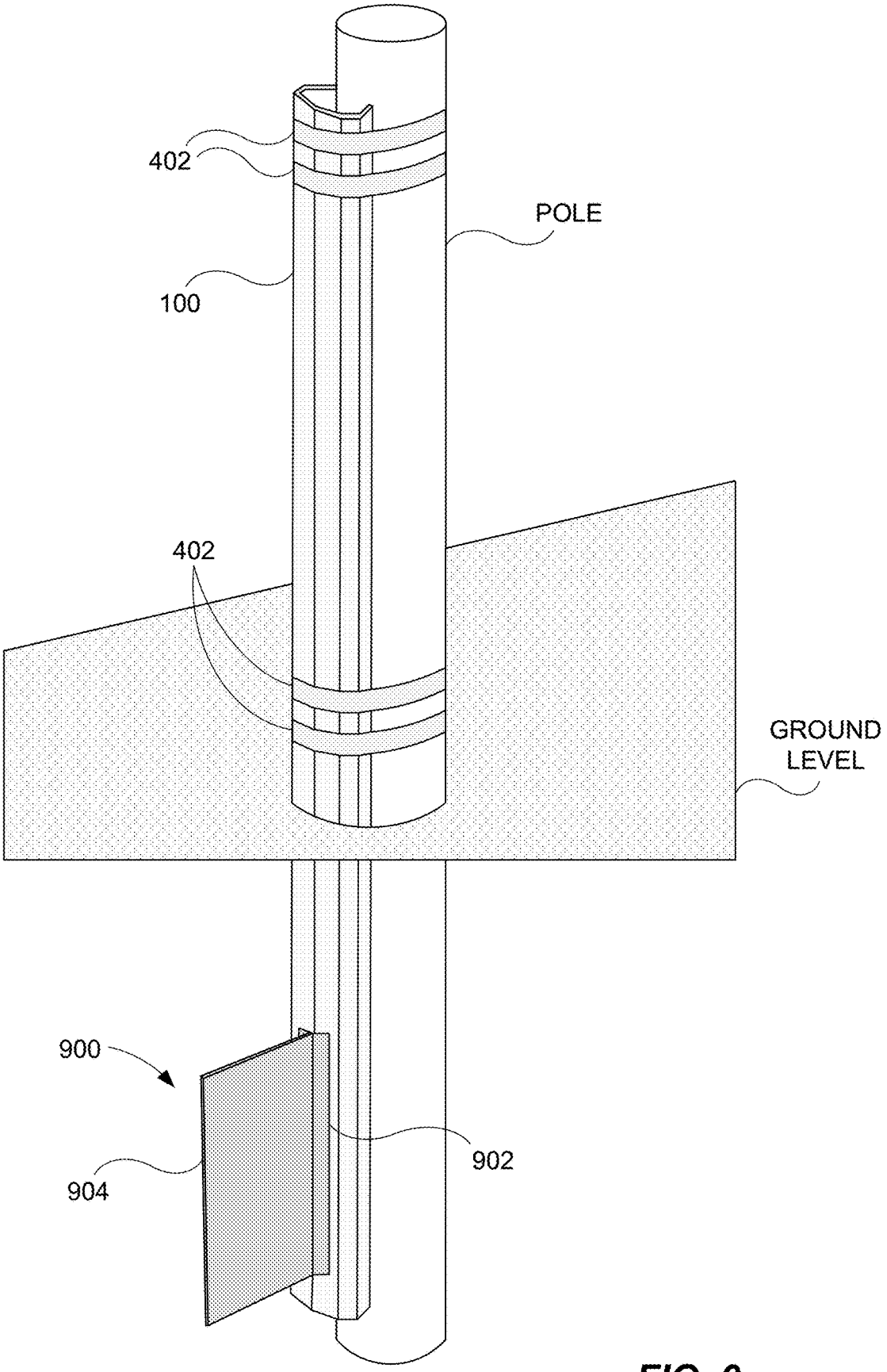
FIG. 9 illustrates a combined above-ground and below-ground view of an example truss having a fin and attached to a pole, in accordance with the disclosed technology.

Alternatively or in addition, referring to FIG. 9, the truss 100 can include a fin 900. The fin 900 can be located at a position on the truss 100 such that the fin 900 is in a subterranean location when the truss 100 is installed. The fin 900 can include a mounting plate 902 and a fin plate 904. The mounting plate 902 can be attached to the body of the truss 100, and the fin plate 904 can be attached to the mounting plate 902. Alternatively or in addition, the fin plate 904 can be attached directly to the truss 100 (e.g., without a mounting plate 902). The fin 900 can be attached or connected to the truss 100 by any fasteners, connectors, or attachment method. For example, the fin 900 can be welded, riveted, bolted, or otherwise fastened to the truss.

Figure 10A:
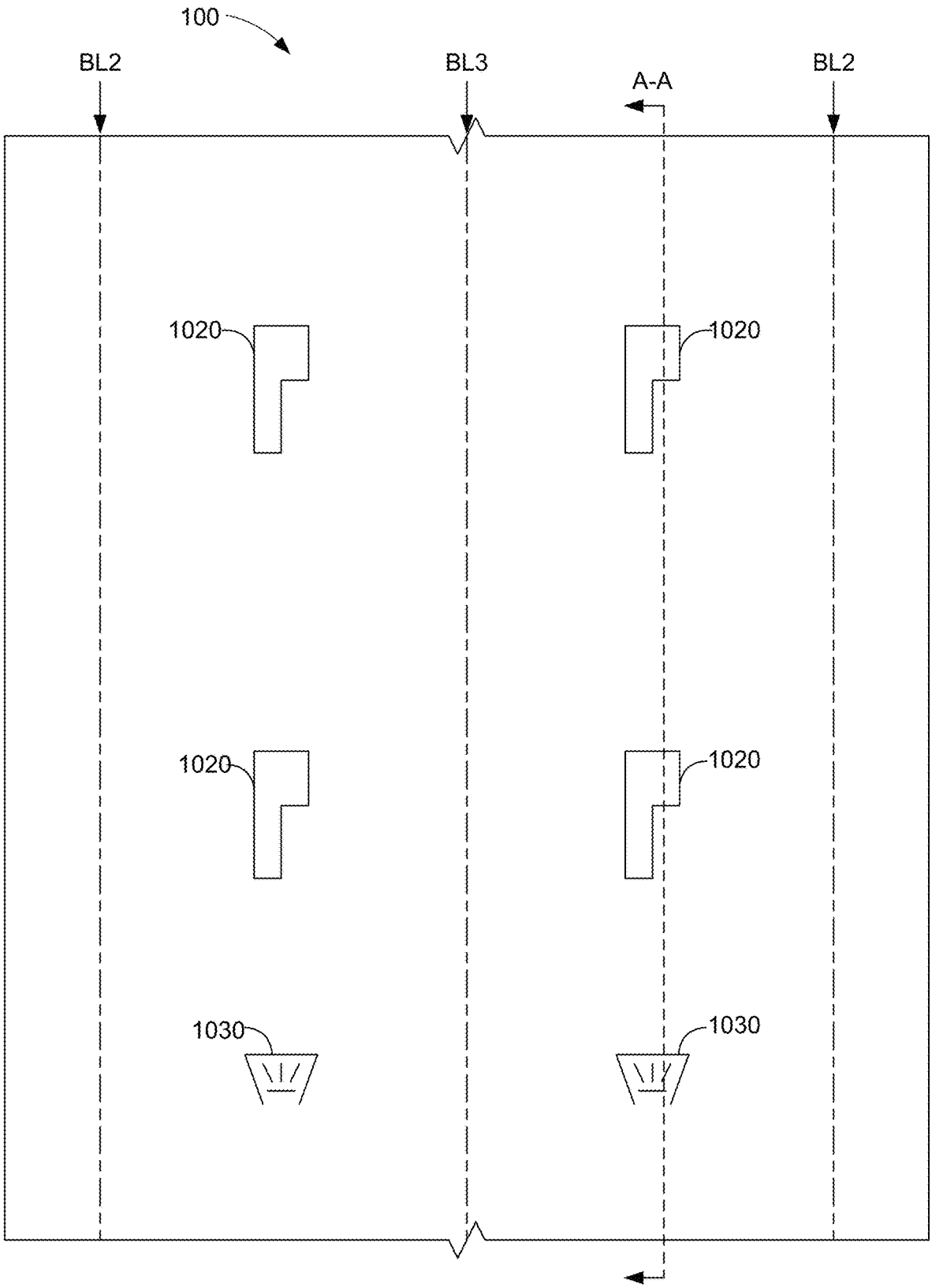
FIG. 10A illustrates a from view of an example truss that is configured to engage a fin, in accordance with the disclosed technology.
Figure 10B:
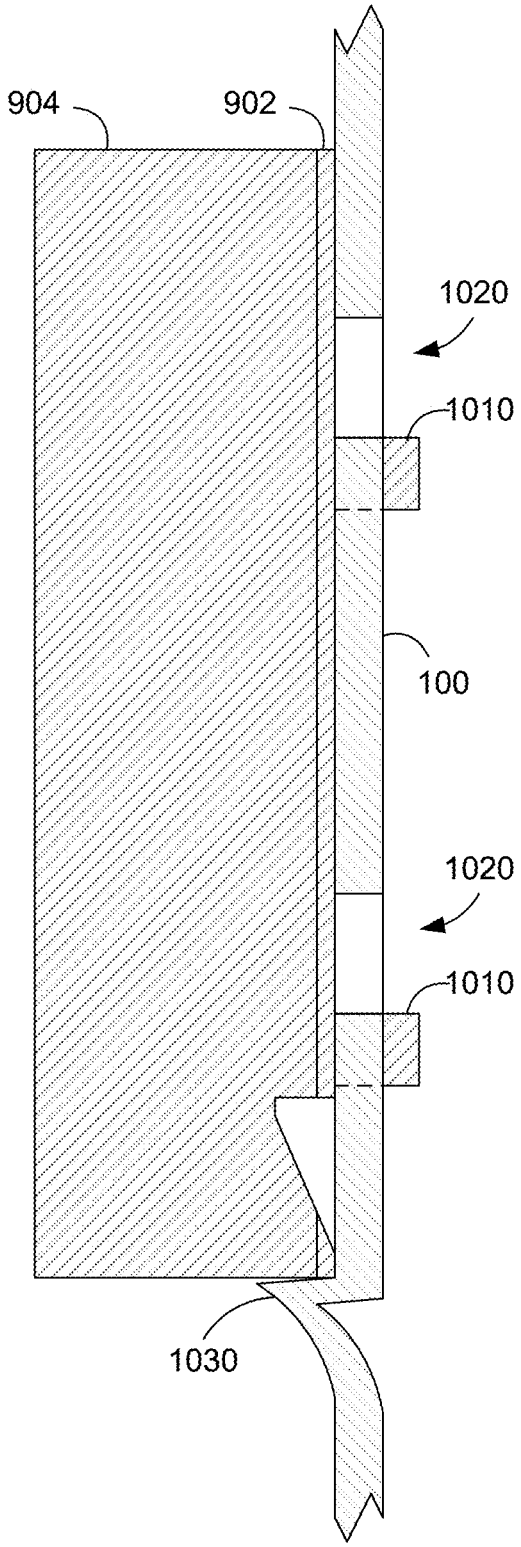
FIG. 10B illustrates a cross-section of the truss of FIG. 10A, taken along line A-A, having a fin attached thereto, in accordance with the disclosed technology.

Alternatively or in addition, the fin 900 can be attached to the truss 100 without additional fasteners. For example, referring to FIGS. 10A and 10B, the fin 900 can include tabs 1010 on the back of the mounting plate 902, and the tabs 1010 can be configured to slide into and engage slots 1020 cut into the body of the truss 100. The slots 1020 can have a wide portion configured to easily receive a tab 1010 and a narrow portion having a width that is approximately equal to (or slightly larger) than the width of the tab 1010 for securing the tab 1010 to the truss's 100 body. The truss 100 can include one or more raised portions 1030 for supporting and aligning the fin 900 to the truss's 100 body. The raised portions 1030 can be punched, pressed, or stamped outwardly from the truss's 100 body. As shown in FIG. 10B, the fin 900 can include an opening 1040 to allow the fin 900 to mate with and engage the truss's 100 body before without interfering with the raised portion 1030.

Regardless of attachment method, the fin 900 can increase the contact surface area of the truss assembly between the truss and the soil. This additional surface area can increase the pole's overturn moment. Stated otherwise, the fin 900 can provide an improved foundation capacity for the pole, which can help prevent pole leaning and/or overturn. The surface area of the shark fin and the soil type can directly correlate to the increase in overturn capacity. Thus, the dimensions of the fin 900 can be adjusted based on the soil type in which a particular pole is installed, such that a desired overturn capacity can be reached without using unnecessary material for the fin 900.

Although not illustrated, it is contemplated that multiple fins 900 can be attached to a single truss 100. The fins 900 can be positioned at different depths below ground. Alternatively or in addition, two or more fins 900 can be positioned at the same or different depths (e.g., extending radially outwardly from the center of the pole in different directions).

It is contemplated that the fin 900 can be attachable to (or modified to be attachable to) any existing truss (i.e., retrofitting a prior art truss). That being said, the disclosed truss 100 provides large flat surfaces, which increases the ease of design for inclusion of the fin 900 and ease of attachment of the fin 900 to the truss's 100 body.

While certain examples of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and can include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A truss for reinforcing a pole, the truss comprising:

an elongate body having a pair of opposite ends connected by a pair of longitudinal edges, a first side portion including one of the longitudinal edges, a second side portion including the other of the longitudinal edges, and a center portion connecting the first side portion and the second side portion, wherein:

the first side portion includes a first substantially straight section and a second substantially straight section separated by a first bend having a first angle that is greater than 45 degrees, the second side portion includes a third substantially straight section and a fourth substantially straight section separated by a second bend having a second angle that is greater than 45 degrees, and an end of the truss comprises a non-planar end configured for insertion into the ground, wherein an edge of the first substantially straight section and an edge of the fourth substantially straight section are each configured to be perpendicular to a tangential edge of the pole when contacting the pole.

2. The truss of claim 1, wherein the first angle and the second angle are both in a range between approximately 60 degrees and approximately 80 degrees.

3. The truss of claim 1, wherein the truss is configured to contact an exterior of the pole via only the longitudinal edges.

4. The truss of claim 1, wherein the elongate body forms a hollow interior portion configured to face the pole when the truss is installed.

5. The truss of claim 1, wherein a length of the first substantially straight section is approximately equal to a length of the fourth substantially straight section.

6. The truss of claim 1, wherein a length of the second substantially straight section is approximately equal to a length of the third substantially straight section.

7. The truss of claim 1, wherein:

the center portion comprises:

a fifth substantially straight section and a sixth substantially straight section; and a third bend separating the fifth substantially straight section and the sixth substantially straight section, the third bend having a third angle, and the truss further comprises:

a fourth bend separating the second substantially straight section of the first side portion and the fifth substantially straight section of the center portion, the fourth bend having a fourth angle; and a fifth bend separating the third substantially straight section of the second side portion and the sixth substantially straight section of the center portion, the fifth bend having a fifth angle.

8. The truss of claim 7, wherein a length of the fifth substantially straight section is approximately equal to a length of the sixth substantially straight section.

9. The truss of claim 7, wherein the third angle is in a range between approximately 5 degrees and approximately 25 degrees.

10. The truss of claim 7, wherein the fourth angle and the fifth angle are both in a range between approximately 60 degrees and approximately 80 degrees.

11. The truss of claim 7, wherein the first bend, the second bend, the fourth bend, and the fifth bend have a common radius.

12. The truss of claim 7, wherein:

the first substantially straight section and a portion of the first bend defines a first length, the second substantially straight section and a portion of the first bend and the fourth bend defines a second length, the fifth substantially straight section and a portion of the fourth bend and the third bend defines a third length, and the third length comprises a length that is at least $5/16^{th}$ of an inch greater than a length of each of the first length and the second length.

13. The truss of claim 12, wherein the third length is at least 2.50 inches longer than the first length and at least 2.00 inches longer than the second length.

14. The truss of claim 1, wherein the non-planar end comprises a v-shaped end.

15. The truss of claim 1, wherein the non-planar end comprises a rounded end.

16. The truss of claim 1, wherein the first substantially straight section and the fourth substantially straight section are each angled inwardly toward the truss.

17. A pole reinforcement system comprising:

a truss comprising:

an elongate body having a pair of opposite ends connected by a pair of longitudinal edges, a first side portion including one of the longitudinal edges, a second side portion including the other of the longitudinal edges, and a center portion connecting the first side portion and the second side portion, wherein the first side portion includes a first substantially straight section and a second substantially straight section separated by a first bend having a first angle that is greater than 45 degrees, wherein the second side portion includes a third substantially straight section and a fourth substantially straight section separated by a second bend having a second angle that is greater than 45 degrees, an end of the truss comprises a non-planar end configured for insertion into the ground, wherein an edge of the first substantially straight section and an edge of the fourth substantially straight section are each configured to be perpendicular to a tangential edge of the pole when contacting the pole; and one or more bands configured to attach the truss to a pole.

18. The pole reinforcement system of claim 17 further comprising:

a foundation plate attachable to the pole at an underground location on the pole.

19. The pole reinforcement system of claim 18, wherein the foundation plate comprises:

a first portion, a second portion, a third portion, and a fourth portion; and one or more apertures extending through foundation plate, wherein:

the first portion forms a first flange and the fourth portion forms a second flange, the second portion extends from the first portion at a first angle, the third portion extends from the fourth portion at a second angle, and the foundation plate is configured to attach to the pole at an underground location when the pole is embedded in the ground.

20. The pole reinforcement system of claim 17, wherein the truss further comprises a fin extending outwardly from an outer surface of the truss, the fin being located at an underground location on the truss when the truss is installed on the pole.

* * * * *